US008517125B2

(12) United States Patent
Lockwood

(10) Patent No.: US 8,517,125 B2
(45) **Date of Patent: *Aug. 27, 2013**

(54) IMPREGNATED MATERIAL WITH VARIABLE EROSION PROPERTIES FOR ROCK DRILLING

(75) Inventor: Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 1004 days.

This patent is subject to a terminal disclaimer.

(21) Appl. No.: 11/779,104

(22) Filed: Jul. 17, 2007

(65) Prior Publication Data

US 2008/0282618 A1 Nov. 20, 2008

Related U.S. Application Data

(60) Provisional application No. 60/938,827, filed on May 18, 2007.

(51) Int. Cl.

| | |
|---|---|
| ***E21B 10/36*** | (2006.01) |
| ***B32B 5/16*** | (2006.01) |
| ***E21B 10/567*** | (2006.01) |
| ***B22F 1/02*** | (2006.01) |

(52) U.S. Cl.

CPC ..... *E21B 10/567* (2013.01); *B22F 1/025* (2013.01)

USPC ..... 175/434; 175/425; 175/420.2; 428/403; 427/217

(58) Field of Classification Search

USPC ..... 175/420.2, 426, 425, 434, 374; 428/403; 427/217

See application file for complete search history.

(56) References Cited

U.S. PATENT DOCUMENTS

| | | | | |
|---|---|---|---|---|
| 4,624,830 | A * | 11/1986 | Barr | 419/7 |
| 4,723,996 | A | 2/1988 | Brunet et al. | |
| 4,797,241 | A | 1/1989 | Peterson et al. | |
| 5,089,182 | A | 2/1992 | Findeisen et al. | |
| 5,518,077 | A | 5/1996 | Blackman et al. | |
| 5,598,621 | A | 2/1997 | Littecke et al. | |
| 5,676,496 | A | 10/1997 | Littecke et al. | |
| 5,755,298 | A | 5/1998 | Langford, Jr. et al. | |
| 6,095,265 | A | 8/2000 | Alsup | |
| 6,102,140 | A * | 8/2000 | Boyce et al. | 175/374 |
| 6,170,583 | B1 | 1/2001 | Boyce | |
| 6,238,280 | B1 | 5/2001 | Ritt et al. | |

(Continued)

FOREIGN PATENT DOCUMENTS

| | | |
|---|---|---|
| DE | 69627053 | 8/2000 |
| DE | 10031833 A1 | 1/2001 |

(Continued)

OTHER PUBLICATIONS

Combined Search and Examination Report for United Kingdom Application No. 0714147.6, mailed on Dec. 4, 2009 (3 pages).

(Continued)

*Primary Examiner* — Cathleen Hutchins

(74) *Attorney, Agent, or Firm* — Osha Liang LLP

(57) ABSTRACT

A cutting structure that includes a plurality of encapsulated particles dispersed in a first matrix material, the encapsulated particles comprising: an abrasive grit encapsulated within a shell, wherein the shell comprises a second matrix material different from the first matrix material is disclosed.

29 Claims, 7 Drawing Sheets

(56) References Cited

U.S. PATENT DOCUMENTS

| | | | | |
|---|---|---|---|---|
| 6,319,460 | B1 | 11/2001 | Fang | |
| 6,394,202 | B2 | 5/2002 | Truax et al. | |
| 6,610,113 | B1 | 8/2003 | Mehrotra et al. | |
| 6,742,611 | B1 | 6/2004 | Illerhaus et al. | |
| 7,810,588 | B2 | 10/2010 | McClain et al. | |
| 2006/0081402 | A1 * | 4/2006 | Lockwood et al. | 175/374 |
| 2006/0162967 | A1 | 7/2006 | Brackin et al. | |
| 2006/0213128 | A1 | 9/2006 | Sung | |
| 2008/0017421 | A1 | 1/2008 | Lockwood | |
| 2008/0202821 | A1 | 8/2008 | McClain et al. | |

FOREIGN PATENT DOCUMENTS

| | | | |
|---|---|---|---|
| DE | 102005048687 | A1 | 5/2006 |
| EP | 0046374 | | 2/1982 |
| EP | 0493351 | A2 | 7/1992 |
| GB | 2362655 | | 11/2001 |
| GB | 2405413 | | 3/2005 |
| GB | 2419617 | A | 5/2006 |
| GB | 2 436 974 | A | 10/2007 |
| GB | 2440438 | | 1/2008 |
| GB | 2 443 574 | A | 5/2008 |
| GB | 2450177 | A | 12/2008 |
| GB | 2454589 | A | 5/2009 |
| RU | 2216435 | | 11/2003 |
| WO | 9936658 | | 7/1999 |
| WO | 0123630 | | 4/2001 |
| WO | 0245907 | | 6/2002 |
| WO | 2004029310 | | 4/2004 |
| WO | 2006063136 | | 6/2006 |

OTHER PUBLICATIONS

U.S. Office Action for Utility U.S. Appl. No. 11/779,083, mailed on Nov. 18, 2009 (11 pages).

Combined Search and Examination Report for corresponding Application No. GB0714147.6 dated Dec. 5, 2007, (8 pages).

German Final Office Action for related Application No. 102008048687.8, dated Mar. 16, 2009 (10 pages).

Combined Search and Examination Report dated Nov. 20, 2007, issued in GB Application No. 0714150.0 (8 pages).

Combined Search and Examination Report issued in related United Kingdom Application No. GB1005530.9 dated Apr. 22, 2010 (2 pages).

U.S. Office Action issued in related U.S. Appl. No. 11/779,083 dated Mar. 4, 2010 (9 pages).

U.S. Office Action issued in related U.S. Appl. No. 12/021,131 dated Mar. 30, 2010 (16 pages).

Response to Examination Report dated Dec. 7, 2009, to Examination Report dated Aug. 6, 2009, for corresponding Application GB0714150.0 (17 pages).

Examination Report for United Kingdom Application No. 0714150.0, mailed Aug. 6, 2009 (9 pages).

Response to Examination Report dated Jun. 23, 2009, to Examination Report dated Jul. 29, 2008, for corresponding Application GB0714150.0 (7 pages).

Response to Office Action filed Oct. 30, 2009, in response to the Official Action dated Apr. 20, 2009, in Canadian Application No. 2,593,951 (25 pages).

Combined Search and Examination Report for United Kingdom Application No. 0820485.1, mailed on Jan. 6, 2009 (7 pages).

Examination Report for United Kingdom Application No. 0820485.1, mailed Feb. 1, 2010 (1 page).

Response to Examination Report filed Sep. 18, 2009, in response to the Examination Report dated Dec. 5, 2007, for United Kingdom No. 0714147.6 (21 pages).

Combines Search and Examination Report for United Kingdom Application No. 0714147.6 mailed on Dec. 5, 2007 (5 pages).

Examination Report for United Kingdom Application No. 0714147.6, mailed Dec. 4, 2009 (2 pages).

Canadian Office Action for Canadian Application No. 2,594,037, mailed Sep. 2, 2009 (3 pages).

Response to Final Office Action dated Feb. 18, 2010, for U.S. Appl. No. 11/779,083 (11 pages).

Notice of Allowance and Fee(s) Due with Notice of References Cited dated Sep. 3, 2010 in related U.S. Appl. No. 11/779,083 (8 pages).

Canadian Office Action for related Application 2,594,037 dated Sep. 2, 2009 (3 pages).

Examiner's Report Cited in Corresponding Canadian Patent Application No. 2594037 dated Mar. 26, 2012 (3 pages).

* cited by examiner

IMPREGNATED MATERIAL WITH VARIABLE EROSION PROPERTIES FOR ROCK DRILLING

CROSS-REFERENCE OF RELATED APPLICATIONS

This application, pursuant to 35 U.S.C. §119, claims the benefit of U.S. Patent Application No. 60/938,827, filed on May 18, 2007, which is herein incorporated by reference in its entirety.

BACKGROUND OF INVENTION

1. Field of the Invention

Embodiments disclosed herein relate generally to drill bits, and more particularly to drill bits having impregnated cutting surfaces and the methods for the manufacture of such drill bits.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper movement of fluid used to remove the rock cuttings and cool the exposed diamonds is important for the proper function and performance of diamond impregnated bits. The cutting face of a diamond impregnated bit typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

An example of a prior art diamond impregnated drill bit is shown in FIG. 1. The impregnated bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impregnated bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impregnated bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 22 in accordance with the '202 patent comprises a shank 24 and a crown 26. Shank 24 is typically formed of steel and includes a threaded pin 28 for attachment to a drill string. Crown 26 has a cutting face 29 and outer side surface 30. According to one embodiment, crown 26 is formed by infiltrating a mass of tungsten-carbide powder impregnated with synthetic or natural diamond, as described above.

Crown 26 may include various surface features, such as raised ridges 32. Preferably, formers are included during the manufacturing process so that the infiltrated, diamond-impregnated crown includes a plurality of holes or sockets 34 that are sized and shaped to receive a corresponding plurality of diamond-impregnated inserts 36. Once crown 26 is formed, inserts 36 are mounted in the sockets 34 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 34 can be inclined with respect to the surface of the crown 26. In this embodiment, the sockets are inclined such that inserts 36 are oriented substantially in the direction of rotation of the bit, so as to enhance cutting.

As a result of the manufacturing technique of the '202 patent, each diamond-impregnated insert is subjected to a total thermal exposure that is significantly reduced as compared to previously known techniques for manufacturing infiltrated diamond-impregnated bits. For example, diamonds imbedded according to methods disclosed in the '202 patent have a total thermal exposure of less than 40 minutes, and more typically less than 20 minutes (and more generally about 5 minutes), above 1500° F. This limited thermal exposure is due to the shortened hot pressing period and the use of the brazing process.

The total thermal exposure of methods disclosed in the '202 patent compares very favorably with the total thermal exposure of at least about 45 minutes, and more typically about 60-120 minutes, at temperatures above 1500° F., that occurs in conventional manufacturing of furnace-infiltrated, diamond-impregnated bits. If diamond-impregnated inserts are affixed to the bit body by adhesive or by mechanical means such as interference fit, the total thermal exposure of the diamonds is even less.

With respect to the diamond material to be incorporated (either as an insert, or on the bit, or both), diamond granules are formed by mixing diamonds with matrix power and binder into a paste. The paste is then extruded into short "sausages" that are rolled and dried into irregular granules. The process for making diamond-impregnated matrix for bit bodies involves hand mixing of matrix powder with diamonds and a binder to make a paste. The paste is then packed into the desired areas of a mold. The resultant irregular diamond distribution has clusters with too many diamonds, while other areas are void of diamonds. The diamond clusters lack sufficient matrix material around them for good diamond retention. The areas void or low in diamond concentration have poor wear properties. Accordingly, the bit or insert may fail prematurely, due to uneven wear. As the motors or turbines powering the bit improve (higher sustained RPM), and as the drilling conditions become more demanding, the durability of diamond-impregnated bits needs to improve. What is still needed, therefore, are techniques for improving the wear properties of, rate of penetration of, and diamond distribution in impregnated cutting structures.

SUMMARY OF INVENTION

In one aspect, embodiments disclosed herein relate to a cutting structure that includes a plurality of encapsulated particles dispersed in a first matrix material, the encapsulated particles comprising: an abrasive grit encapsulated within a shell, wherein the shell comprises a second matrix material different from the first matrix material.

In another aspect, embodiments disclosed herein relate to a drill bit that includes a bit body; and a plurality of ribs formed in the bit body; wherein at least one rib comprises a first matrix material infiltrated with a plurality of encapsulated particles; the encapsulated particles include an abrasive grit encapsulated within a shell; wherein the shell comprises a second matrix material different from the first matrix material.

In yet another aspect, embodiments disclosed herein relate to a method of forming an impregnated cutting structure that includes loading a plurality of encapsulated particles and a first matrix material into a mold cavity, the encapsulated particles comprising: an abrasive grit encapsulated within a shell, wherein the shell comprises a second matrix material, different from the first matrix material and; heating the encapsulated particles within the first matrix material to form an impregnated cutting structure, where the first and second matrix materials are different.

Other aspects and advantages of the invention will be apparent from the following description and the appended claims.

DETAILED DESCRIPTION

In one aspect, embodiments disclosed herein relate to encapsulated particles. In other aspects, embodiments disclosed herein relate to impregnated cutting structures or impregnated drill bits containing encapsulated particles. The use of encapsulated particles in cutting structures is described for example in U.S. Patent Publication No. 2006/0081402 and U.S. Provisional Application Ser. No. 60/831,945, which are herein incorporated by reference.

Figure 3:
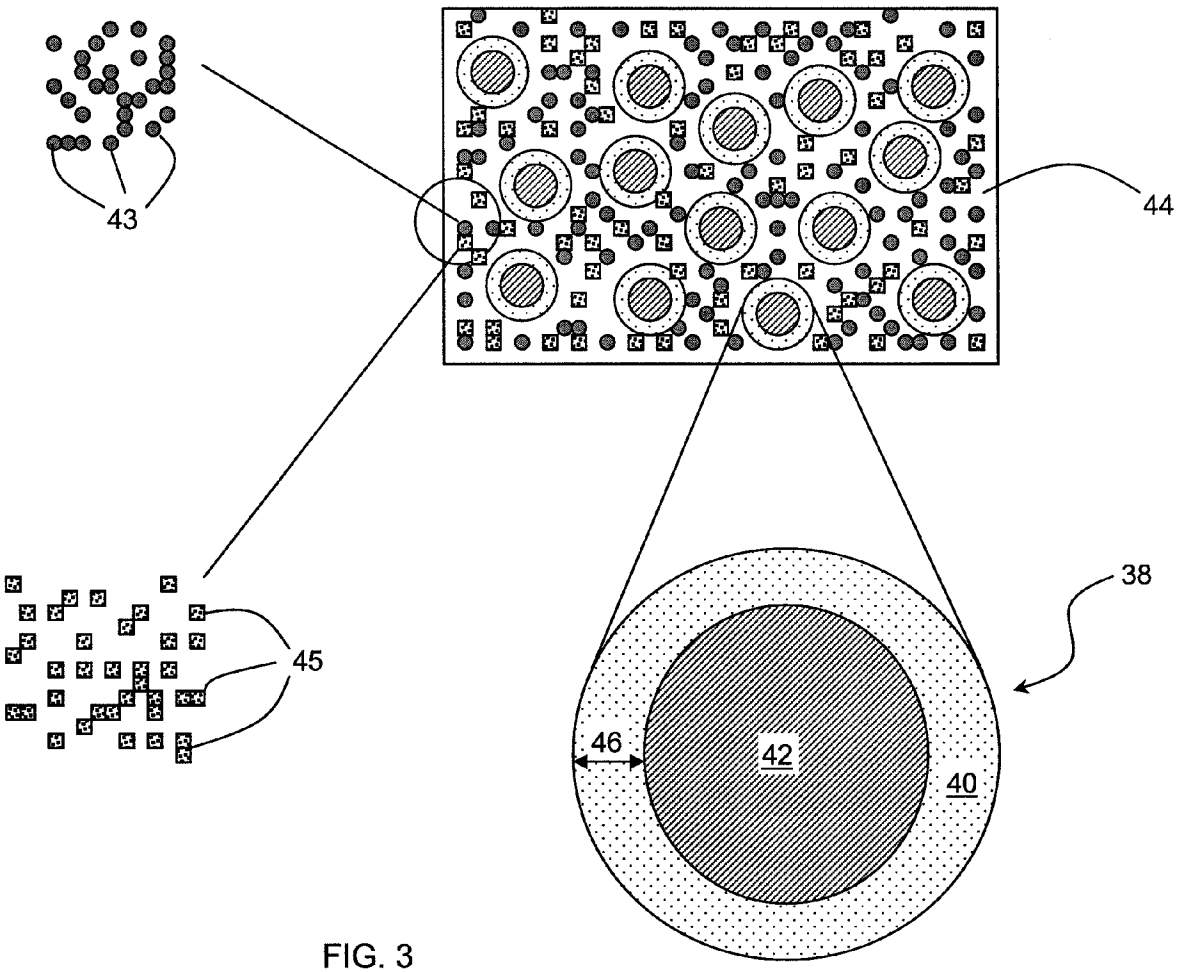
FIG. 3 illustrates a cross-section of an embodiment of an encapsulated particle infiltrated into a cutting structure.

Referring to FIG. 3, a cross-section of an embodiment of an encapsulated particle 38 infiltrated into a cutting structure is illustrated. As shown in FIG. 3, a first matrix material 44 may surround the encapsulated particle 38. The encapsulated particle 38 may include a shell 40, formed from a second matrix material. This shell 40 may coat or surround an abrasive grit 42. Each of these component parts will be further discussed, including a description of embodiments of various impregnated cutting structures.

First Matrix Material

In some embodiments, the first matrix material 44, or gap material, which retains the encapsulated particles 38 in the cutting structure may exhibit several characteristics. In some embodiments, the first matrix material 44 may include tungsten (W) or a derivative such as tungsten carbide (WC), sintered tungsten carbide/cobalt (WC—Co) (spherical or crushed), cast tungsten carbide (particulate or crushed), macro-crystalline tungsten carbide, carburized tungsten carbide, or other tungsten carbides.

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

Referring once again to FIG. 3, the first matrix material 44 may comprise a hard particle material 43 and/or a binder phase 45. In some embodiments, first matrix 44 may be formed from hard particle materials such as carbides or nitrides of tungsten, vanadium, boron, titanium, or combinations thereof. In other embodiments, the following hard particle materials 43 may be used to form first matrix 44: tungsten carbide (WC), tungsten (W), sintered tungsten carbide/cobalt (WC—Co) (spherical or crushed), cast tungsten carbide (spherical or crushed) and/or combinations of these materials with an appropriate optional binder phase 45. The binder phase 45 facilitates bonding of particles and may be metallic and/or non-metallic. In some embodiments of the present invention, the metallic binder phase may be selected from cobalt, nickel, iron, chromium, copper, molybdenum and their alloys, and combinations thereof. In other embodiments of the present invention, a non-metallic binder phase may be selected from polyethylene glycol (PEG) or organic wax.

In various embodiments, the first matrix 44 may include hard particles 43 ranging in size from about 1 to 200 micrometers, or about 5 to 150 micrometers, or about 10 to 100 micrometers. One of ordinary skill in the art would recognize that the particular combination of hard particle material and particle size used in the matrix material 44 may depend, for example, on whether the particles disclosed herein are being used in a insert or a rib of a bit body so that desired properties such as wear resistance and ability to be infiltrated may be optimized.

In some embodiments, the hard particle 43 component of first matrix 44 may include at least one of macrocrystalline tungsten carbide particles, carburized tungsten carbide particles, cast tungsten carbide particles, and sintered tungsten carbide particles. In other embodiments, non-tungsten carbides of vanadium, chromium, titanium, tantalum, niobium, and other carbides of the transition metal group may be used. In yet other embodiments, carbides, oxides, and nitrides of Group IVA, VA, or VIA metals may be used.

In other embodiments, the first matrix material 44 may include hard and/or binder phase compounds 45, and may include metals, metal alloys, carbides, and combinations thereof. In some embodiments, first matrix 44 may include Co, Ni, Cu, Fe, and combinations and alloys thereof. In various other embodiments, the first matrix material 44 may include a Cu—Mn—Ni alloy, Ni—Cr—Si—B—Al—C alloy, Ni—Al alloy, and/or Cu—P alloy. In other embodiments, the first matrix material 44 may include carbides in addition to Co, Cu, Ni, Fe, and combinations and alloys thereof. In yet other embodiments, the first matrix material 44 may include, by weight, from 50% to 70% of at least one carbide and from 30% to 50% of at least one metal/metal binder compound 45 to facilitate bonding of matrix material and impregnated materials. In one embodiment, the resulting first matrix material may be chosen to be very tough, yet maintain good cutting properties. Additionally, tungsten carbide, in particular a fine-grained tungsten carbide, may present an optimum matrix for controlled wear and cuttings removal.

One of ordinary skill in the art would recognize that the particular combination of carbides and binders used in the first matrix material 44 may be tailored depending on the anticipated final use of the cutting structure. For example, the combination used may be customized for desired properties such as wear resistance and ability to be infiltrated. The first matrix material 44 has sufficient hardness so that the impregnated materials, namely the encapsulated particles, exposed at the cutting face are not pushed into the matrix material under the very high pressures commonly encountered in drilling. In addition, the first matrix material 44 may be selected to withstand continuous mechanical action such as rubbing, scraping, or erosion that typically occurs during drilling so that the impregnated materials are not prematurely released.

Encapsulated Particles

Encapsulated particles may be formed using encapsulation techniques known to one skilled in the art. As shown in FIG. 3, the encapsulated particles 38 include an abrasive grit 42 surrounded by a shell 40 comprising a second matrix material, different from the first matrix material 44 described above. These encapsulated particles may then be impregnated into a cutting structure such as a drill bit or a rib of a drill bit. In some embodiments, shell 40 may form a uniform coating around abrasive grit 42.

While the encapsulated particles 38 are primarily shown as spheres of approximately the same size and shape, the present invention is not so limited. The encapsulated particles may include other shapes, such as ellipses, rectangles, squares, or non-regular geometries, or mixtures of the shapes. In some embodiments, encapsulated particles 40 may have an average diameter (or equivalent diameter) ranging from 0.3 to 3.5 mm. In other embodiments, encapsulated particles 38 may have an average diameter ranging from 0.4 to 3.0 mm; from 0.5 to 2.5 mm in other embodiments; and from 0.7 to 2.0 mm in yet other embodiments. In other embodiments, encapsulated particles 38 may include particles not larger than would be filtered by a screen of 5 mesh. In other embodiments, encapsulated particles 38 may range in size from −10+25 mesh. In some embodiments, encapsulated particles 38 may have an average diameter (or equivalent diameter) ranging from 0.7 to 3.0 mm.

Particle sizes are often measured in a range of mesh sizes, for example −40+80 mesh. The term "mesh" actually refers to the size of the wire mesh used to screen the particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the particles is defined by the largest and smallest grade of mesh used to screen the particles. Particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm.

Figure 4:
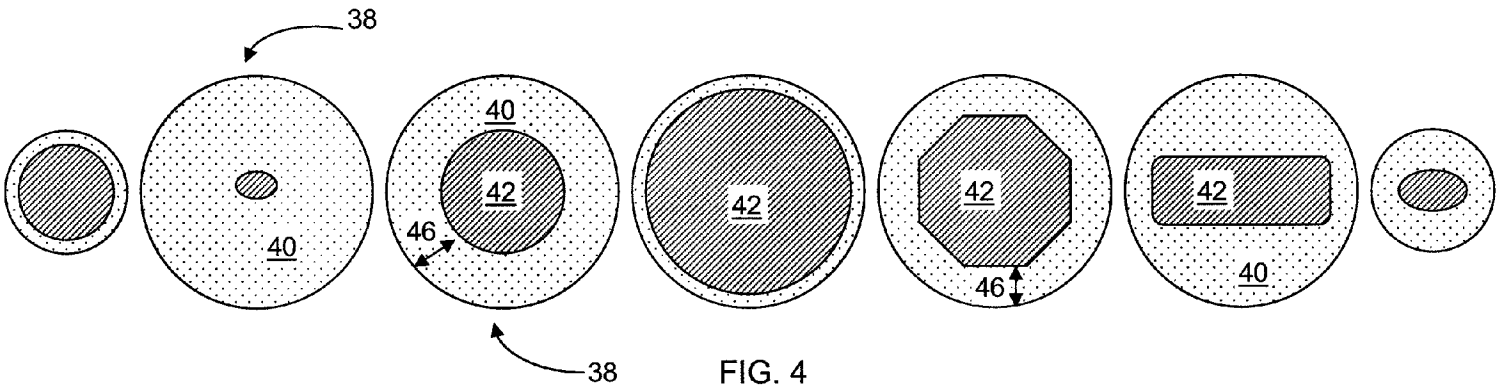
FIG. 4 illustrates a sample of the variety of embodiments of encapsulated particles.

Referring to FIG. 4, an array of possible embodiments of encapsulated particles is illustrated. In various embodiments, encapsulated particles may be obtained from commercial sources, or synthesized using encapsulation techniques known to those of ordinary skill in the art.

Shell Component/Second Matrix Material

The shell 40 may consist of a second matrix material comprising a mixture of a carbide compound and/or a metal alloy using any technique known to those skilled in the art. A desirable shell thickness 46 may vary depending on the final intended use of the cutting structure. Also, the thickness 46 may vary depending on the sizes of abrasive grit 42 used in forming encapsulated particle 38. In some embodiments, shell 40 may have an average thickness 46 ranging from 0.1 to 1.5 mm. In other embodiments, shell 40 may have an average thickness 46 ranging from 0.1 to 1.3 mm; from 0.15 to 1.1 mm in other embodiments; and from 0.2 to 1.0 mm in yet other embodiments. In most embodiments, shell 40 may have an average thickness 46 ranging from 750 micrometers to 10 micrometers.

In some embodiments, the carbide compound of the second matrix material 40 may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used.

In some embodiments, the second matrix material 40 may include at least one of tungsten, cobalt, nickel, iron, chromium, copper, molybdenum and other transition elements and their alloys, and combinations thereof.

According to one embodiment of the present disclosure, the shell or second matrix material 40 is chosen to be different from the first matrix material 44 such as by chemical make-up or particle size ranges/distribution. As stated above, the first matrix material 44 may range in various embodiments, for example, from about 1 to 200 micrometers, from about 1 to 150 micrometers, from about 10 to 100 micrometers, and from about 5 to 75 micrometers in various other embodiments or may be less than 50, 10, or 3 microns in yet other embodiments. The second matrix material, used to form shell 40, may range in size from about 1 to 200 micrometers, from about 1 to 150 micrometers, from about 10 to 100 micrometers, and from about 5 to 75 micrometers in various other embodiments or may be less than 50, 10, or 3 microns in yet other embodiments. In a particular embodiment, the second matrix material may have a mono-modal distribution, while the first matrix material may have a bi- or otherwise multi-modal distribution, or vice versa.

This difference in chemical makeup may translate, for example, into a difference in wear or erosion resistance properties. One of ordinary skill in the art would recognize that the wear properties of the first matrix material 44 relative to the second matrix material 40 may be tailored by changing their respective chemical makeup. Depending on the anticipated final use of the cutting structure, the first matrix 44 may be softer and less wear resistant than the second matrix 40. In another embodiment, the first matrix 44 may be substantially softer and less wear resistant than the second matrix 44. In such an embodiment, the relative ease of erosion of the first matrix would allow the harder encapsulated particles 38 to be exposed to the formation quickly. This may be desirable, for example, when the shell 40, or second matrix thickness 46 is small. For example, when the shell thickness 46 is less than 50 micrometers, it may be desirable to have a second matrix that is more wear resistant than the first matrix.

Alternatively, the second matrix 40 may be softer than the first matrix 44. In another embodiment, the second matrix 40 may be substantially softer than the first matrix 44. This disparity in wear resistance may be desirable, for example, where the shell thickness 46 is large. For example, where the shell thickness is greater than 50 micrometers, it may be desirable to have a second matrix which is less wear resistant than the surrounding first matrix. This may allow for fluid pathways to be created in the cutting structure that may allow for efficient cuttings removal.

Further, while the encapsulated particles 38 are shown as having shells of approximately the same thickness 46, the present invention is not so limited. The thickness and chemical composition of the shell 40 may be tailored to achieve a desirable wear rate. Referring to FIG. 4, abrasive grits may be of different sizes or of different kinds. Furthermore, the shell may be of various thicknesses and comprise various second matrices 40. Encapsulated grit with second matrix materials different from each other could be incorporated into the same cutting structure. These materials may wear at different rates thereby exposing the grits at different rates. The composition and thickness of this second matrix may also affect the rate at which the encapsulated grit is exposed. For example, it may take a longer time to expose the abrasive grit in an encapsulated particle with a larger shell thickness 46 than a grit with a smaller shell thickness 46 of same chemical composition.

Certain embodiments disclosed herein relate to using "uniformly" coated particles. As used herein, the term "uniformly coated" means that that individual particles have similar amounts of coating (i.e., they have relatively the same size), in approximately the same shape (e.g. spherical coating), and that single encapsulated particles 38 are coated rather than forming clusters. The term "uniformly" is not intended to mean that all the particles have the exact same size or exact same amount of coating, but simply that they are substantially uniform. The present inventors have discovered that by using particles having a uniform shell layer coating provides consistent spacing between the particles in the finished parts.

Grit Component

In some embodiments, abrasive grit 42 may be synthetic diamond, CVD coated synthetic diamond, natural diamond, reclaimed natural or synthetic diamond grit, silicon carbide, aluminum oxide, tool steel, boron carbide, cubic boron nitride (CBN), thermally stable polycrystalline diamond (TSP), or combinations thereof.

In some embodiments, abrasive grit 42 may be in the shape of spheres, cubes, irregular shapes, or other shapes. In some embodiments, abrasive grit 42 may range in size from 0.2 to 2.0 mm in length or diameter. In other embodiments, abrasive grit 42 may range in size from 0.3 to 1.5 mm; from 0.4 to 1.2 mm in other embodiments; and from 0.5 to 1.0 mm in yet other embodiments. In other embodiments, abrasive grit 42 may include particles not larger than would be filtered by a screen of 10 mesh. In other embodiments, abrasive grit 42 may range in size from −15+35 mesh. A desirable size for the abrasive grit 42 may range from 0.2 mm to 1.5 mm. Further, one of ordinary skill would recognize that the particle sizes and distribution of the particle sizes of the abrasive particles may be selected to allow for a broad, uniform, or bimodal distribution, for example, depending on a particular application.

As used herein, although particle sizes or particle diameters are referred to, it is understood by those skilled in the art that the particles may not be spherical in shape. Abrasive grit 6 may be in the shape of spheres, cubes, irregular shapes, or other shapes. Referring to FIG. 4, possible embodiments of encapsulated grits are therein illustrated.

Manufacture of Cutting Structures Using Encapsulated Particles

In one embodiment, uniformly coated encapsulated particles are manufactured prior to the formation of the impregnated bit. An exemplary method for achieving "uniform coatings" is to mix the abrasive grit 42, and second matrix material 40 in a commercial mixing machine such as a Turbula Mixer or similar machine used for blending diamonds with matrix. The resultant mix may then be processed through a "granulator" in which the mix is extruded into short "sausage" shapes which are then rolled into balls and dried. The granules that are so formed must be separated using a series of mesh screens in order to obtain the desired yield of uniformly coated crystals. At the end of this process, a number of particles of approximately the same size and shape can be collected, and optionally pre-sintered. Another exemplary method for achieving a uniform matrix coating on the abrasive grits is to use a machine called a Fuji Paudal pelletizing machine. The uniformly coated particles may then be transferred into a mold cavity and formed into an insert or other cutting structure, i.e., rib. One such process is described in U.S. Patent Application Publication No. 2006/0081402, which is herein incorporated by reference in its entirety.

One of ordinary skill in the art would appreciate that the encapsulated particles disclosed herein may be used to form inserts, cutting structures or bit bodies using any suitable method known in the art. Heating of the material can be by furnace or by electric induction heating, such that the heating and cooling rates are rapid and controlled in order to prevent damage to the diamonds. The inserts may be heated by resistance heating in a graphite mold, while bit bodies may be formed by infiltration of a mold. The dimensions and shapes of the inserts and of their positioning on the bit can be varied, depending on the nature of the formation to be drilled.

Infiltration processes that may be used to form an infiltrated bit body of the present disclosure may begin with the fabrication of a mold, having the desired body shape and component configuration. Pellets of uniformly coated encapsulated particles may be loaded into the mold in the desired location, i.e., ribs, and, a matrix material, and optionally a metal binder powder, may be loaded on top of the encapsulated particles. The mass of particles may be infiltrated with a molten infiltration binder and cooled to form a bit body. In a particular embodiment, during infiltration at least a portion of the loaded matrix material may be carried down with the molten infiltrant to fill the gaps between the encapsulated particles. Depending on the size of the encapsulated particles, as well as additional properties, a size distribution of the additional matrix material may be likewise selected such that the additional matrix material possess a sufficient amount of "fine" particles that may be carried down between the encapsulated particles to fill the gaps therebetween.

It will further be understood that the concentration of diamond or abrasive particles in the cutting structures can differ from the concentration of diamond or abrasive particles in the bit body. Diamond concentration may be obtained, for example by varying shell thickness and the matrix loading of the first matrix material. According to one embodiment, the concentrations of diamond in the inserts and in the bit body are in the range of 50 to 120 (100=4.4 carat/$cm^3$). Other embodiments may have a diamond concentration greater than 110, while yet other embodiments may have a diamond concentration less than 85. A diamond concentration of 120 is equivalent to 30 percent by volume of diamond. Those having ordinary skill in the art will recognize that other concentrations of diamonds may also be used depending on particular applications.

Further, while reference has been made to a hot-pressing process above, embodiments disclosed herein may use a high-temperature, high-pressure press (HTHP) process. Alternatively, a two-stage manufacturing technique, using both the hot-pressing and the HTHP, may be used to promote the development of high concentration (>120 conc.) while achieving maximum bond or matrix density. The HTHP press can improve the performance of the final structure by enabling the use of higher diamond volume percent (including bi-modal or multi-modal diamond mixtures) because ultrahigh pressures can consolidate the bond material to near full density (with or without the need for low-melting alloys to aid sintering).

The HTHP process has been described in U.S. Pat. No. 5,676,496 and U.S. Pat. No. 5,598,621. Another suitable method for hot-compacting pre-pressed diamond/metal powder mixtures is hot isostatic pressing, which is known in the art. See Peter E. Price and Steven P. Kohler, "Hot Isostatic Pressing of Metal Powders", Metals Handbook, Vol. 7, pp. 419-443 (9th ed. 1984).

Further, the processing times during sintering or hot-pressing, such as heating and cooling times, may be selected to be sufficiently short, as well as the maximum temperature of the thermal cycle may be selected to be sufficiently low, so that the impregnated materials are not thermally damaged during these processes.

Figure 5:
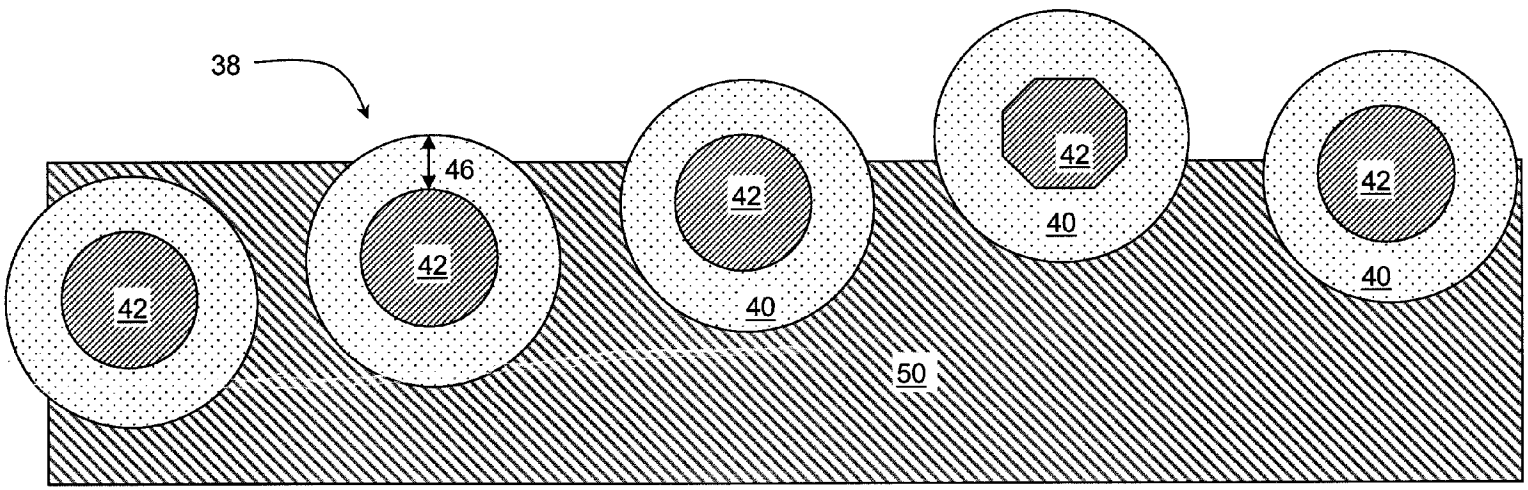
FIG. 5 illustrates a cross-section of another embodiment of a cutting structure.

Referring to FIG. 5, a cross-sectional view of a rib 50 forming part of a diamond impregnated bit is illustrated. A drill bit or a rib on a drill bit may include multiple encapsulated particles 38, described above. The encapsulated particles 38 may be uniform in size, shape, and composition. Alternatively, rib 50 may include encapsulated particles 38 having varied sizes, shapes, and compositions of the components (second matrix 40, abrasive particles 42), as is illustrated in FIG. 5.

In some embodiments, the multiple encapsulated particles 38 on rib 50 may include particles of varying size, varying composition, or combinations thereof. In other embodiments, the multiple encapsulated particles 38 may include shells 40 of varying thickness 46, varying composition, or combinations thereof. In other embodiments, the multiple encapsulated particles 38 may include abrasive particles 42 of varying size, varying composition, varying size distribution, and combinations thereof. In yet other embodiments, the drill bit or a rib on a drill bit may additionally include (be impregnated with) standard grit.

In various embodiments, the encapsulated particles disclosed herein may have localized placement in a drill bit. For example, encapsulated particles may be placed at the top of the bit being the first section of the bit to drill or solely imbedded deeper within the bit for drilling of the latter sections encountered during a bit run. Additionally, one of skill in the art would recognize that it may be advantageous to place the encapsulated particles at other strategic positions, such as, for example, in the gage area, and leading, or trailing sides of a rib/blade.

Projected Wear Progression

Figure 6:
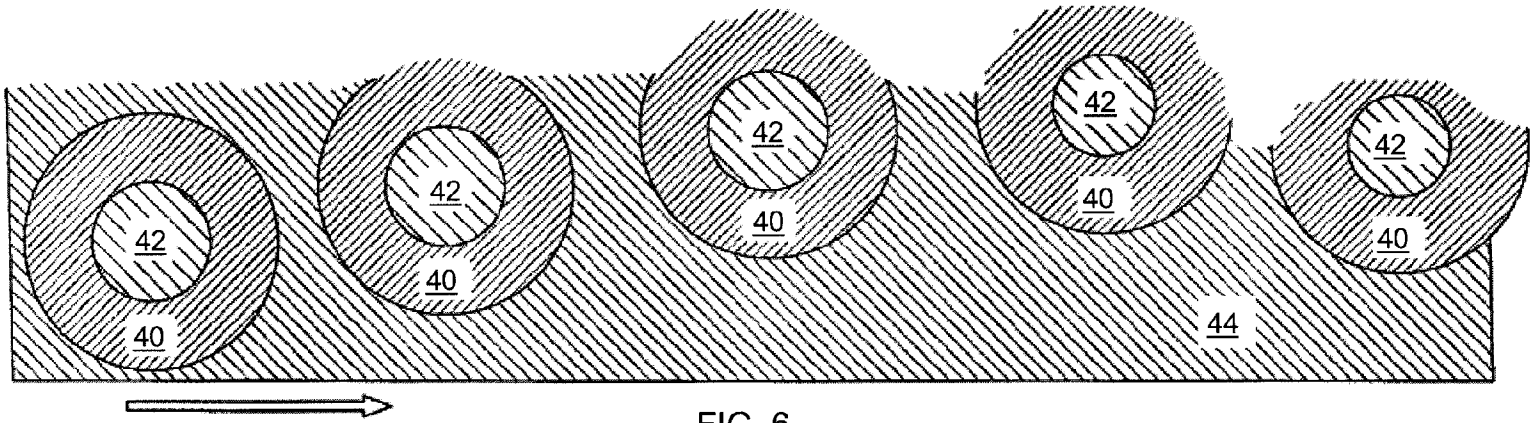
FIG. 6 illustrates a wear progression of the cross-section of an embodiment of a cutting structure.

Referring to FIG. 6, a cross-sectional view of a projected wear progression of a cutting structure is illustrated. As shown in FIG. 6, the first matrix material 44 is comparatively softer than the second matrix material 40 and therefore preferentially erodes. Working from left to right as indicated by the arrow, initially, the first matrix material 44 progressively wears, exposing a top portion of encapsulated particle 38. Upon continued contact with the formation, matrix 44 wears. As matrix layer 44 erodes, encapsulated particle 38 is exposed, thereby increasing the abrasive contact area with the formation.

Figure 7:
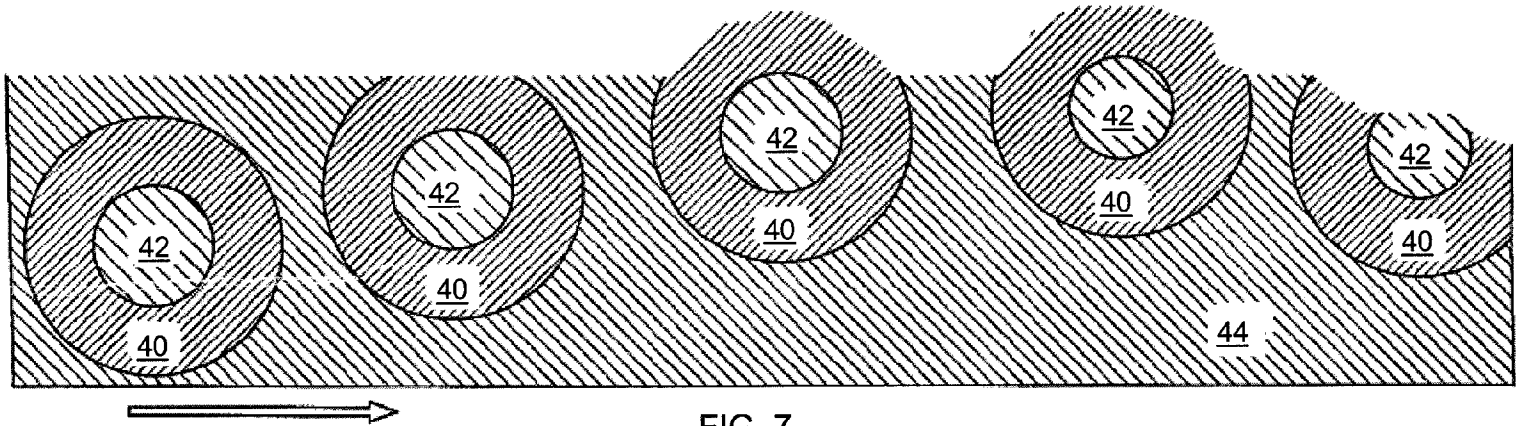
FIG. 7 illustrates a wear progression of the cross-section of an embodiment of a cutting structure

Referring to FIG. 7, a cross-sectional view of a projected wear progression of another embodiment of a cutting structure is similarly illustrated. As shown in FIG. 7, the first matrix material 44 is comparatively harder than the second matrix material 40 and therefore the second matrix material 40 preferentially erodes. Working from left to right as indicated by the arrow, initially, the first matrix material 44 progressively wears, exposing a top portion of encapsulated particle 38. As the shell of the encapsulated particle is exposed, the second matrix layer 40 preferentially erodes, exposing abrasive grits 42. This increases the abrasive contact area with the formation. Furthermore, spacing is created for the efficient clearing of cuttings. Wear may progress until encapsulated particle 38 is worn through. The wear progression allows for the controlled exposure of fresh grit, maintaining a sharp bit during wear. This may lead to an increased rate of penetration compared to bits impregnated solely with diamond grit.

Materials commonly used for construction of bit bodies may be used in the embodiments disclosed herein. Hence, in one embodiment, the bit body may itself be diamond-impregnated. In an alternative embodiment, the bit body includes infiltrated tungsten carbide matrix that does not include diamond. In an alternative embodiment, the bit body can be made of steel, according to techniques that are known in the art. Again, the final bit body includes a plurality of holes having a desired orientation, which are sized to receive and support the inserts. The inserts, which include encapsulated diamond particles, may be affixed to the steel body by brazing, mechanical means, adhesive or the like.

Figure 2:
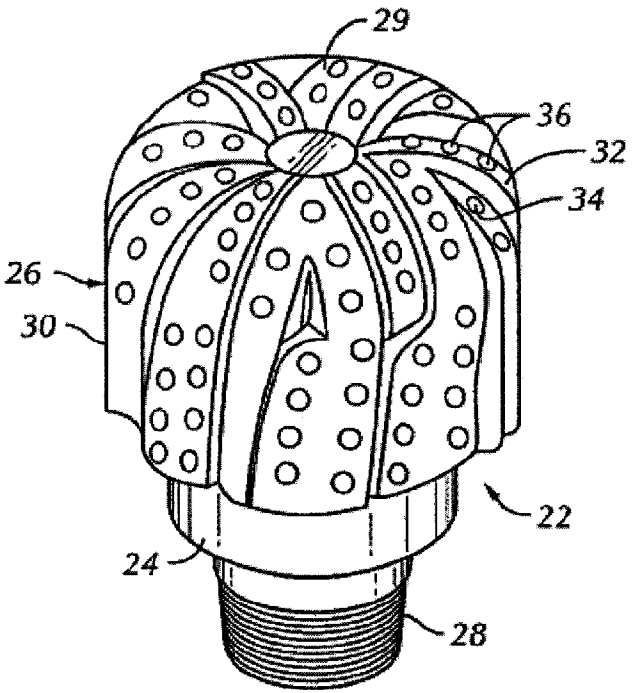
FIG. 2 (Prior Art)
FIG. 2 shows a prior art perspective view of a second type of impregnated bit.
Figure 1:
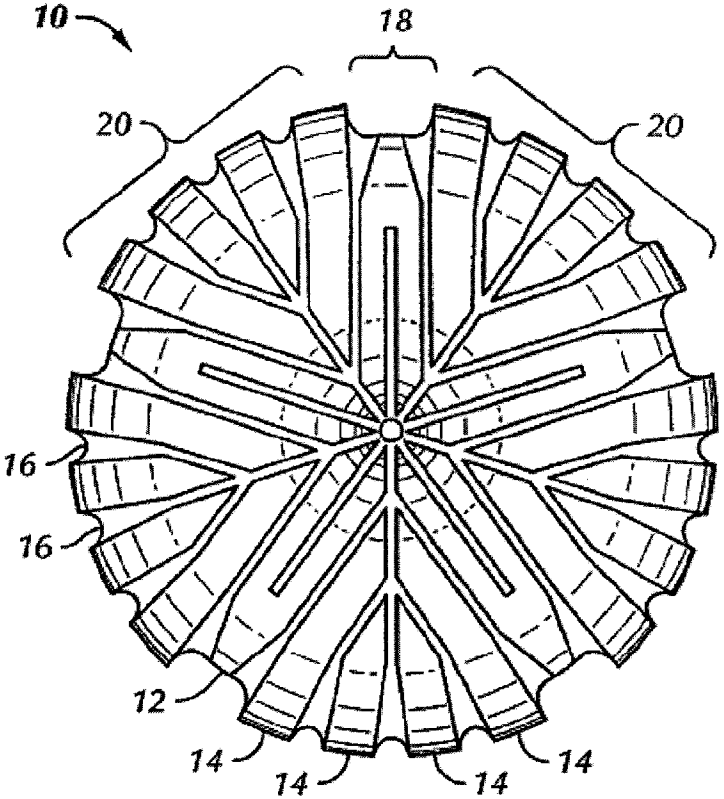
FIG. 1 (Prior Art)
FIG. 1 shows a prior art impregnated bit.

Referring again to FIG. 2, impregnated bits may include a plurality of gage protection elements disposed on the ribs and/or the bit body. In some embodiments, the gage protection elements may be modified to include evenly distributed diamonds. By positioning evenly distributed diamond particles at and/or beneath the surface of the ribs, the impregnated bits are believed to exhibit increased durability and are less likely to exhibit premature wear than typical prior art impregnated bits.

Embodiments disclosed herein, therefore, may find use in any application in which impregnated cutting structures may be used. Specifically, embodiments may be used to create diamond impregnated inserts diamond impregnated bit bodies, diamond impregnated wear pads, or any other diamond impregnated material known to those of ordinary skill in the art. Embodiments may also find use as inserts or wear pads for 3-cone, 2-cone, and 1-cone (1-cone with a bearing & seal) drill bits. Further, while reference has been made to spherical particles, it will be understood by those having ordinary skill in the art that other particles and/or techniques may be used in order to achieve the desired result, namely more even distribution of diamond particles. For example, it is expressly within the scope of the present invention that elliptically coated particles may be used.

EXAMPLES

Example 1

Figure 8:
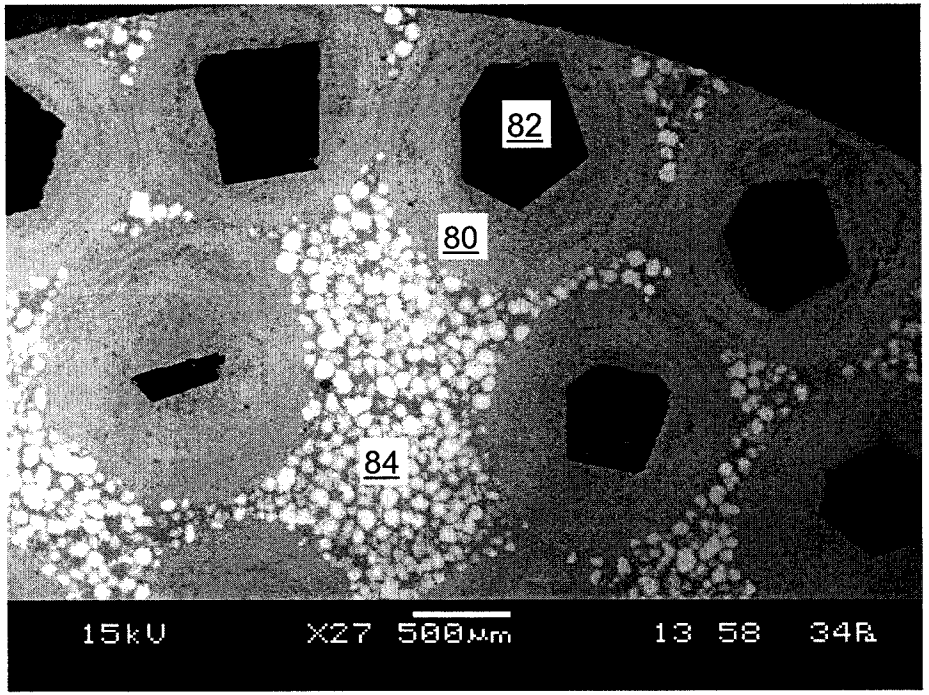
FIG. 8 shows a scanning electron microscopy (SEM) image of a polished surface of an impregnated cutting surface in accordance with one embodiment.

A sample impregnated cutting structure formed in accordance with embodiments of the present disclosure is compared to a comparative sample cutting structure formed by a conventional process. The exemplary impregnated cutting structure is made using encapsulated diamond particles ranging from 25 to 35 mesh. The shell encapsulating the abrasive grit includes 70% WC (0.8 to 3.0 micron particle size with an average of 2 microns), 20% Co, and 10% Cu. The encapsulated particles are placed into the mold, and tungsten shoulder powder (96% W-4% Ni) is then placed on top of the encapsulated particles. Binder cubes of a copper alloy (Cu-23Mn-11Ni-6Sn-4Zn) are further placed on top of the encapsulated particles. Infiltration of the matrix is carried out at 1030° C. Referring to FIG. 8, a scanning electron microscopy (SEM) image of a polished surface of the exemplary impregnated cutting surface is shown. FIG. 8 shows the abrasive grit 82 surrounded by a shell 80 of WC. The spaces between the shell matrix material 90 is filled in with the shoulder powder to form the first matrix 84.

Figure 9B:
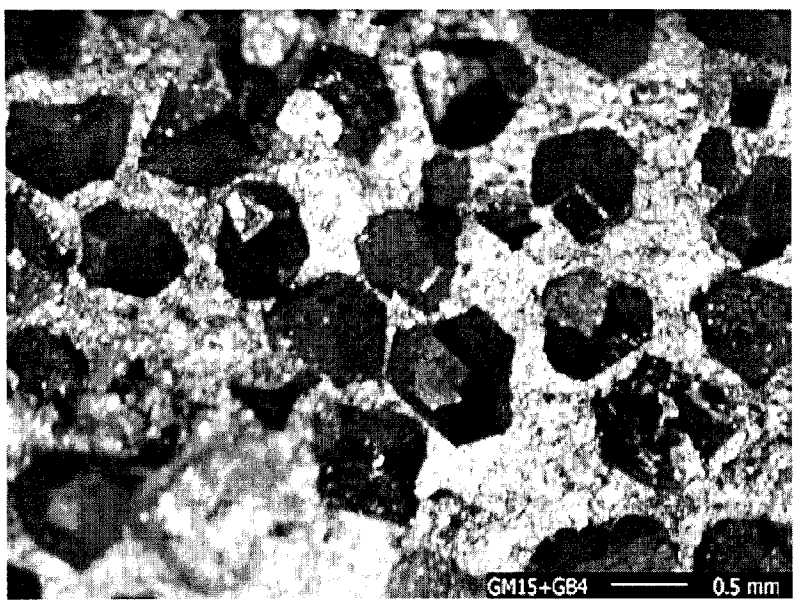
FIGS. 9A and 9B show photographs of the cutting structure shown in FIG. 8 and a comparative sample cutting structure, respectively.
Figure 9A:
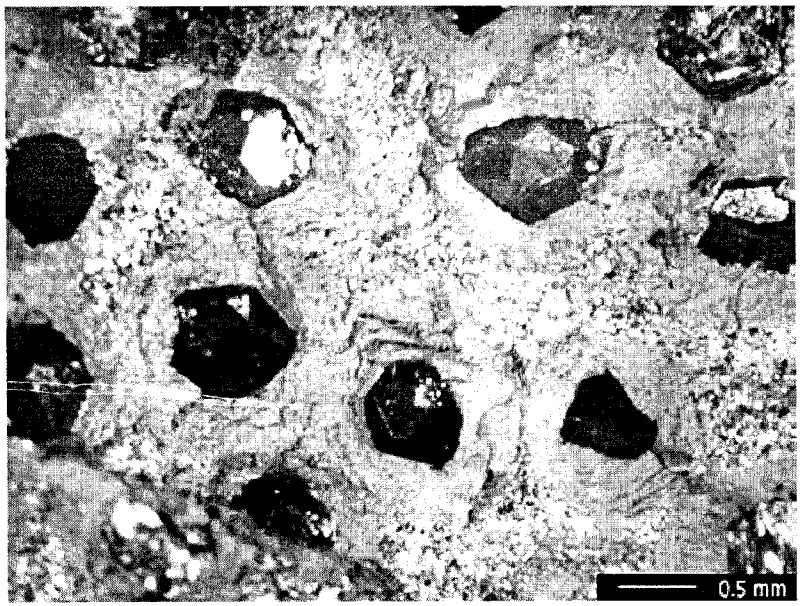

The sample cutting structure is then compared with a conventional impregnated cutting structure. The conventional impregnated cutting structure includes grit impregnated in a matrix of 46% agglomerated WC, 50% cast WC, 2% Ni, and 2% Fe. Referring to FIGS. 9A and 9B, photographs of the enlarged surfaces of the sample cutting structure shown in FIG. 8 and the comparative sample cutting structure, respectively, are shown. FIG. 9B shows poor grit distribution as clusters of grit are evident. In contrast, FIG. 9A shows improved grit distribution because virtually no grit contiguity is observed.

Compressive strength of the cutting structures is determined using ASTM D3967 crush test. For this test, a 13 mm diameter, 13 mm length cylindrical sample was infiltrated in a mold. The sample was centerless ground to create a smooth surface. The cylinder was loaded on the curved surface, between two carbide anvils in a MTS test machine. The load rate was 0.001 in/sec. Load was increased until same failure was achieved. The results are shown in Table 1 below.

TABLE 1

| | Crush Test (psi) |
|---|---|
| Sample 1 | 37,606 |
| Comparative Sample | 21,819 |

As shown in Table 1 below, approximately 21,819 psi is required to bring the standard sample to failure. In contrast, 37,606 psi is required to bring the prototype sample to failure. This shows that the exemplary impregnated sample has significantly improved compressive strength over the conventional sample.

Example 2

Figure 10:
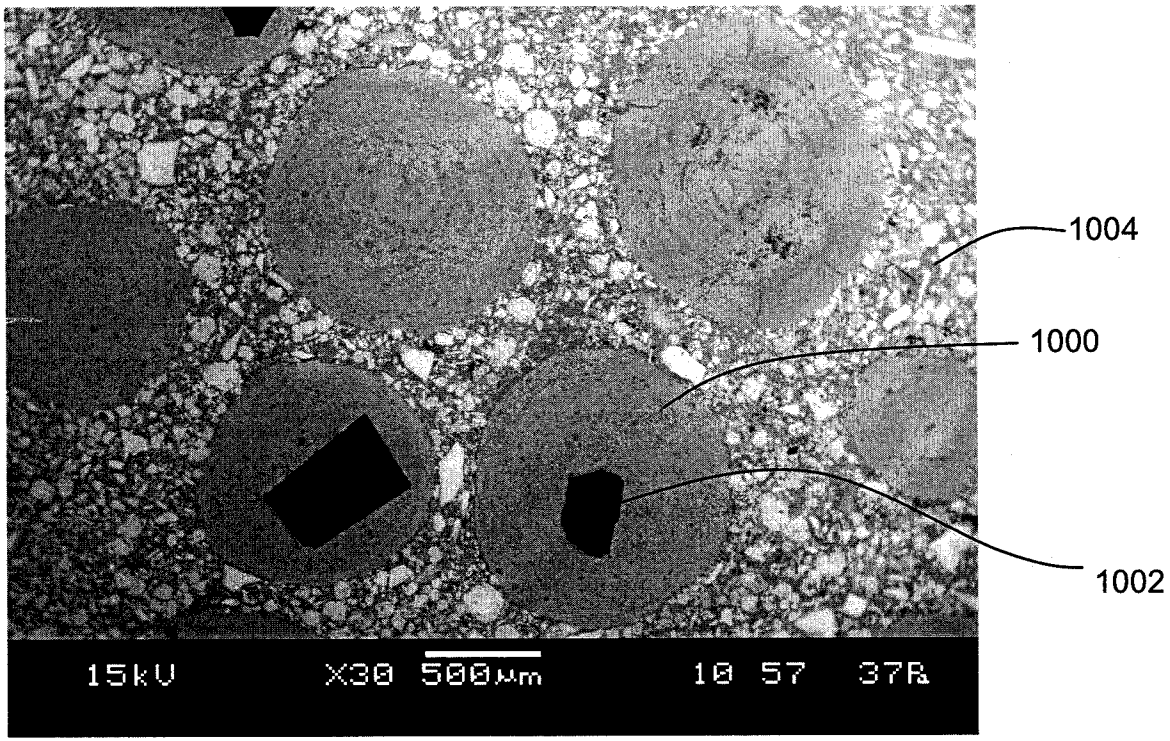
FIG. 10 shows a scanning electron microscopy (SEM) image of a polished surface of an impregnated cutting surface in accordance with one embodiment.

A second sample impregnated cutting structure formed in accordance with embodiments of the present disclosure is compared to the comparative sample cutting structure described above. The exemplary impregnated cutting structure is made using encapsulated diamond particles ranging from 25 to 35 mesh. The shell encapsulating the abrasive grit includes 70% WC (0.8 to 3.0 micron particle size with an average of 2 microns), 20% Co, and 10% Cu. The encapsulated particles are placed into the mold (rib area), and a tungsten carbide matrix mixture that includes 61% agglomerated WC (MAS 3000-5000), 35% cast WC, 2% Ni, and 2% Fe is then placed on top of the encapsulated particles. Binder cubes of a copper alloy (Cu-23Mn-11Ni-6Sn-4Zn) are farther placed on top of the encapsulated particles. Infiltration of the matrix is carried out at 1030° C. Referring to FIG. 10, a scanning electron microscopy (SEM) image of a polished surface of the exemplary impregnated cutting surface is shown. FIG. 10 shows the abrasive grit 1002 surrounded by a shell 1000 of WC. The spaces between the shell matrix material 1000 is filled in with the tungsten carbide matrix mixture to form the first matrix 1004.

The sample cutting structure is then compared with the conventional impregnated cutting structure describe above in Example 1. Compressive strength of the cutting structures is determined using ASTM D3967 crush test. For this test, a 13 mm diameter, 13 mm length cylindrical sample was infiltrated in a mold. The sample was centerless ground to create a smooth surface. The cylinder was loaded on the curved surface, between two carbide anvils in a MTS test machine. The load rate was 0.001 in/sec. Load was increased until same failure was achieved. The results are shown in Table 1 below.

TABLE 1

| | Crush Test (psi) |
|---|---|
| Sample 2 | 34,462 |
| Comparative Sample | 21,819 |

Advantageously, embodiments of the present disclosure may include at least one of the following. As discussed above, embodiments disclosed herein may provide uniform and improved wear properties, improved diamond retention, and increased diamond concentration (without diamond cluttering) for a given volume. Embodiments disclosed herein may also provide for the controlled exposure of fresh grit. Removal of the grit to expose fresh grit may be controlled by the hardness of the shell and the relative wear properties of the first and second matrices, and may be tailored for the hardness of the earth formation. Particularly, use of a mono-modal distribution of tungsten carbide encapsulating the diamond particles may allow for a more uniform and controlled wear rate of the surrounding carbide to expose the diamond. Use of a fine-grain carbide may also allow for a more uniform and controlled wear rate as larger particles may take longer to wear away as compared to fine-grained particles, resulting in reduced rate of penetration. Historically, a mono-modal packing of fine-grained carbides would not infiltrate well; however, improvements in infiltration may be obtained by pre-sintering the granules of diamond encapsulated with a fine-grained carbide.

In selected embodiments, each abrasive grit may have a substantially uniform coating of the second matrix material around it and thereby may provide a substantially consistent spacing between the grits. This may prevent grit contiguity and provide an adequate matrix around each abrasive grit to assure good retention, and a consistent wear life. Thus, advantageously, certain embodiments, by creating impregnated structures having more uniform distribution of abrasive grits, may result in products having more uniform wear properties, improved particle retention, and increased abrasive grit concentration for a given volume, when compared to prior art structures. In addition, coating uniformity permits the use of minimal coating thickness, thus allowing an increased abrasive grit concentration to be used.

In selected embodiments, abrasive grits have a substantially uniform matrix layer around each particle and provide a substantially consistent spacing between the diamonds. This prevents grit contiguity and provides adequate matrix around each abrasive grit to assure good diamond retention. Uniform grit distribution permits high grit concentration without risk of contiguity, and provides for consistent wear life.

The relative distribution of abrasive grit may be discussed in terms of grit "contiguity," which is a measure of the number of abrasive grits that are in direct contact with another grit. Ideally, if complete distribution existed, the grit to grit contiguity would be 0% (i.e., no two abrasive grits are in direct contact). By contrast, analysis of typical currently used impregnated cutting structures has revealed a grit contiguity of approximately 50% (i.e., approximately half of the abrasive grits are in contact with other grits).

The grit contiguity may be determined as follows:

$$C_{D\text{-}D}=(2P_{D\text{-}D})/(2P_{D\text{-}D}+P_{D\text{-}M}) \quad \text{(Eq. 1)}$$

where $P_{D\text{-}D}$ equals the total number of contiguous points of grit along the horizontal lines of a grid placed over a sample photo, and $P_{D\text{-}M}$ equals the total number of points where grit contacts matrix.

Additionally, in the embodiments disclosed herein, the selection of first and second matrices may provide improved cutting structures to drill through formations of specific hardnesses. The first matrix may be very tough, have good infiltration properties, and yet maintain good cutting properties. The toughness of this first matrix may reduce blade breakage and allow the blade height to increase, which would increase the drilling life of the blade. Encapsulation of the grit with a second matrix layer may prevent grit contiguity, and increases grit-to-grit distance. This may thereby improve the diamond distribution over traditional impregnation methods and allow for improved cutting efficiency.

The disparity in wear properties between the first and second matrices may allow for tailoring of the some of the properties of the cutting structure such as grit concentration, wear rate, controlled exposure of encapsulated grit to the formation, cuttings removal and robustness. If a high grit concentration is required for drilling a particularly hard formation, the shell thickness may be small. This may advantageously allow more encapsulated grit to be packed into the same cutting structure. The presence of the second matrix may prevent grit contiguity and allow the grit to be more evenly distributed within the first matrix. In such an embodiment, the second matrix material may be selected to be more wear resistant than the first matrix material in order to expose the concentrated grit at a slower rate. This may result in a robust cutting instrument wherein the grit is exposed in a controlled fashion.

If more efficient cuttings removal is required, the cutting instrument may have a first matrix that is selected to be more wear resistant than the second matrix material. The second matrix may preferentially partially wear away creating fluid pathways within the cutting instrument, while exposing the abrasive grit. This may result in a cutting instrument with superior cuttings removal properties.

Further, conventional bits rely on grit hot pressed inserts for a large portion of the wear; however, such segments are typically restricted to approximately thirty to forty percent of the rib volume due to design limitations. Because the cutting structures of the present disclosure may provide for improved rate of penetration by virtue of improved wear patterns, a bit that typically relies on grit hot pressed inserts for wear may instead be provided with ribs infiltrated with the encapsulated particles as disclosed herein. Such bits may possess improved wear across a larger volume of rib, as compared to conventional bits having grit hot pressed inserts.

Cost efficiency may also be realized with use of embodiments disclosed herein. As abrasive particles, especially synthetic diamond crystals, increase in size, the greater the cost of the particles. For example, an increase in mesh size from −25+35 mesh to −18+25 mesh can double the price of high quality synthetic grit, with large natural diamond even higher in cost. The properties of the first and second matrix materials may be selected, for example, so that the shells of the encapsulated particles may have a greater wear resistance and the surrounding matrix may have greater infiltration or other properties.

Thus, embodiments disclosed herein may allow for an effective diameter of the encapsulated materials without such drastic increases in cost. Furthermore, some embodiments may include a hard particle, such as tungsten or silicon carbide, which has even lower costs as compared to diamond or other super abrasives. Therefore, cost savings may be achieved while maintaining or even improving rate of penetration (ROP), thus lowering the drilling cost per foot.

Thus, advantageously, certain embodiments, by creating impregnated structures having more uniform distribution, may result in products having more uniform wear properties, improved particle retention, and increased grit concentration for a given volume, when compared to prior art structures. In addition, coating uniformity permits the use of minimal coating thickness, thus allowing an increased grit concentration to be used.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All priority documents are herein fully incorporated by reference for all jurisdictions in which such incorporation is permitted. Further, all documents cited herein, including testing procedures, are herein fully incorporated by reference for all jurisdictions in which such incorporation is permitted to the extent such disclosure is consistent with the description of the present invention.

What is claimed:

1. A cutting structure comprising:

a plurality of encapsulated particles dispersed in a first matrix material comprising a first hard particle phase and a first binder phase, the encapsulated particles comprising:

an abrasive grit encapsulated within a shell, wherein the shell comprises a second matrix material, different from the first matrix material; and wherein the second matrix material comprises a second hard particle phase and a second metal binder phase; and wherein the average particle size of the first hard particle phase is different from the average particle size of the second hard particle phase.

2. The cutting structure of claim 1, where the first hard particle phase of the first matrix material and the second hard particle phase of the second matrix material individually are selected from the group consisting of tungsten, sintered tungsten carbide, cast tungsten carbide, and carbides of tungsten, vanadium, chromium, titanium, tantalum, and niobium.

3. The cutting structure of claim 2, where the second matrix material comprises particles having an average particle size of less than 10 micrometers.

4. The cutting structure of claim 1, where the first binder phase of the first matrix material and the second metal binder phase of the second matrix material individually are selected from the group consisting of copper, cobalt, nickel, iron, chromium, molybdenum, and alloys thereof.

5. The cutting structure of claim 1, where the first binder phase is selected from the group consisting of polyethylene glycol and wax.

6. The cutting structure of claim 1, wherein the abrasive grit is selected from the group consisting of synthetic diamond, natural diamond, thermally stable polycrystalline diamond, and cubic boron nitride.

7. The cutting structure of claim 1, wherein the encapsulated particles have a diameter ranging from about 0.7 mm to 3.0 mm.

8. The cutting structure of claim 1, wherein one of the first hard particle phase or the second hard particle phase comprises a mono-modal particle size distribution and the other of the first hard particle phase or the second hard particle phase comprises a multi-modal particle size distribution.

9. The cutting structure of claim 1, wherein the average particle size of the first hard particle phase is larger than the average particle size of the second hard particle phase.

10. A drill bit, comprising:

a bit body; and a plurality of ribs formed in the bit body;

wherein at least one rib comprises a first matrix material comprising a first hard particle phase and a first binder phase, infiltrated with a plurality of encapsulated particles; the encapsulated particles comprising an abrasive grit encapsulated within a shell; wherein the shell comprises a second matrix material different from the first matrix material; and wherein the second matrix material comprises a second hard particle phase and a second metal binder phase;

wherein the average particle size of the first hard particle phase is different from the average particle size of the second hard particle phase.

11. The drill bit of claim 10, where the first hard particle phase of the first matrix material and the second hard particle phase of the second matrix material individually are selected from the group consisting of tungsten, sintered tungsten carbide, cast tungsten carbide, and carbides of tungsten, vanadium, chromium, titanium, tantalum, and niobium.

12. The drill bit of claim 11, where the second matrix material comprises particles having an average particle size of less than 10 micrometers.

13. The drill bit of claim 10, where the first binder phase of the first matrix material and the second metal binder phase of the second matrix material individually are selected from the group consisting of cobalt, copper, nickel, iron, chromium, molybdenum, and alloys thereof.

14. The drill bit of claim 10, where the first matrix material is selected from the group consisting of polyethylene glycol and wax.

15. The drill bit of claim 10, wherein the abrasive grit is selected from the group consisting of natural diamond, synthetic diamond, thermally stable polycrystalline diamond, and cubic boron nitride.

16. A method of forming an impregnated cutting structure comprising:

loading a plurality of encapsulated particles and a first matrix material comprising a first hard particle phase and a first binder phase into a mold cavity, the encapsulated particles comprising:

an abrasive grit encapsulated within a shell, wherein the shell comprises a second matrix material, comprising a second hard particle phase and a second metal binder phase, different from the first matrix material wherein the average particle size of the first hard particle phase is different from the average particle size of the second hard particle phase; and heating the encapsulated particles within the first matrix material to form an impregnated cutting structure, where the first and second matrix materials are different.

17. The method of claim 16, where the first and second matrix materials individually comprise at least one of tungsten, carbides of tungsten, vanadium, chromium, titanium, tantalum, and niobium.

18. The method of claim 16, where the first and second matrix materials individually comprise at least one of cobalt, copper, nickel, iron, chromium, molybdenum, and alloys thereof.

19. The method of claim 16, where the first matrix material comprises the first binder which is at least one of polyethylene glycol and wax.

20. The method of claim 16, wherein the abrasive grit comprises at least one of natural diamond, synthetic diamond, TSP, and CBN.

21. The method of claim 16, wherein the shell of the encapsulated particle may be infiltrated in the dewaxed, pre-sintered, or fully sintered stages.

22. The method of claim 16, further comprising:

mixing the first matrix material with the encapsulated particle, prior to loading into the mold.

23. The method of claim 16, further comprising:

mixing the first matrix material with the encapsulated particle and the binder, prior to loading into the mold.

24. The method of claim 16, where the loaded materials are allowed to dry in the mold before infiltration.

25. The method of claim 16, wherein the encapsulated grit and first matrix material are sequentially loaded into the mold.

26. The method of claim 16, further comprising:

infiltrating the first matrix material and the encapsulated particles with an infiltration alloy.

27. The method of claim 16, further comprising:

hot pressing the first matrix and encapsulated particles.

28. A cutting structure comprising:

a plurality of encapsulated particles dispersed in a first matrix material, the encapsulated particles comprising:

an abrasive grit encapsulated within a shell, wherein the shell comprises a second matrix material, different from the first matrix material;

wherein the first matrix material has a greater hardness value than the second matrix material.

29. The cutting structure of claim 28, wherein the second matrix material has a greater amount of a metal binder phase than the first matrix material.

* * * * *